US010947610B2

(12) United States Patent
Verma et al.

(10) Patent No.: US 10,947,610 B2
(45) Date of Patent: Mar. 16, 2021

(54) MOORING CHAINS COMPRISING HIGH MANGANESE STEELS AND ASSOCIATED METHODS

(71) Applicant: ExxonMobil Upstream Research Company, Spring, TX (US)

(72) Inventors: Neerav Verma, Deer Park, TX (US); Andrew J. Wasson, Spring, TX (US); Hyun-Woo Jin, Easton, PA (US); Haiping He, Tomball, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 5 days.

(21) Appl. No.: 16/541,662

(22) Filed: Aug. 15, 2019

(65) Prior Publication Data

US 2020/0063245 A1 Feb. 27, 2020

Related U.S. Application Data

(60) Provisional application No. 62/720,709, filed on Aug. 21, 2018.

(51) Int. Cl.
*B63B 21/20* (2006.01)
*C22C 38/38* (2006.01)
(Continued)

(52) U.S. Cl.
CPC ..... *C22C 38/38* (2013.01); *B63B 21/20* (2013.01); *B63B 21/50* (2013.01); *C22C 38/001* (2013.01);
(Continued)

(58) Field of Classification Search
CPC ..... B63B 21/20; B63B 2021/203
See application file for complete search history.

(56) References Cited

U.S. PATENT DOCUMENTS 4,428,781 A 1/1984 Norstrom
8,752,361 B2 6/2014 Smeets et al.
(Continued)

FOREIGN PATENT DOCUMENTS

GB 2132963 A * 7/1984
KR 101654684 9/2016

OTHER PUBLICATIONS

E. Fontaine, Seawater Corrosion of Ropes & Chain (SCORCh), Oct. 20, 2008, AMOG Consulting, http://www.fpsoresearchforum.com/JIP_Docs/Proposal_SCORCH_Rev0.pdf.

*Primary Examiner* — Sunil Singh
(74) *Attorney, Agent, or Firm* — Bruce M. Bordelon; Leandro Arechederra, III

(57) ABSTRACT

Mooring chains used in offshore environments are typically formed from carbon steels due to their wear and fatigue resistance properties. Although carbon steels may exhibit robust mechanical properties, they are susceptible to corrosion, which can shorten the usable working lifetime of mooring chains, particularly in a seawater environment. Austenitic steels comprising high percentages of manganese may have comparable mechanical properties to the carbon steels commonly used in mooring chains, yet exhibit less susceptibility to corrosion. Austenitic steels suitable for use in mooring chains and other structures in contact with or exposed to a seawater environment may comprise: 0.4-0.8 wt. % C, 12-25 wt. % Mn, 4-15 wt. % Cr, a non-zero amount of Si<3 wt. %, a non-zero amount of Al<0.5 wt. %, a non-zero amount of N<0.1 wt. %, <5 wt. % Mo, and balance Fe and inevitable impurities.

17 Claims, 4 Drawing Sheets

(51) Int. Cl.

| | |
|---|---|
| ***C22C 38/06*** | (2006.01) |
| ***C22C 38/02*** | (2006.01) |
| ***B63B 21/50*** | (2006.01) |
| ***C22C 38/00*** | (2006.01) |

(52) U.S. Cl.
CPC ..... *C22C 38/02* (2013.01); *C22C 38/06* (2013.01); *B63B 2021/203* (2013.01); *B63B 2021/505* (2013.01)

(56) References Cited

U.S. PATENT DOCUMENTS

| | | | |
|---|---|---|---|
| 2001/0024621 | A1 | 9/2001 | Leppanen |
| 2003/0167659 | A1 | 9/2003 | Raines |
| 2007/0107808 | A1 | 5/2007 | Bauk et al. |
| 2008/0240970 | A1 | 10/2008 | Eto et al. |
| 2012/0160363 | A1 | 6/2012 | Jin et al. |
| 2014/0261918 | A1 | 9/2014 | Jin et al. |
| 2017/0088910 | A1 | 3/2017 | Jin et al. |
| 2017/0312861 | A1 | 11/2017 | Jin et al. |
| 2017/0312862 | A1 | 11/2017 | Wasson et al. |
| 2017/0349983 | A1 | 12/2017 | Jin et al. |
| 2018/0021895 | A1 | 1/2018 | Wasson et al. |

* cited by examiner

MOORING CHAINS COMPRISING HIGH MANGANESE STEELS AND ASSOCIATED METHODS

CROSS REFERENCE TO RELATED APPLICATIONS

This application claims the priority benefit of United States Provisional Patent Application No. 62/720,709 filed Aug. 21, 2018, entitled MOORING CHAINS COMPRISING HIGH MANGANESE STEELS AND ASSOCIATED METHODS.

FIELD

The present disclosure relates to mooring chains having corrosion and fatigue resistance.

BACKGROUND

Offshore platforms and related offshore structures have been used for a variety of purposes in the energy industry including recovery of natural resources such as oil and gas, wind power generation, and the like. Early offshore structures were rigid and extended completely from the water surface to the benthic floor (earthen surface) below. More recently, floating offshore structures have been developed, particularly for use in deep water or hostile environments. Floating offshore structures may include, for example, spar platforms, single column floater (SCF) platforms, tension leg platforms, floating storage and offloading vessels (FSO vessels), drilling ships, offshore wind turbines, and the like.

Mooring chains are used to secure various types of floating offshore structures to the earthen surface below the water line. Over their lifetime, mooring chains experience considerable motion-induced stress and may be susceptible to accumulated fatigue damage. Various grades of carbon steel are commonly used materials for fabricating mooring chains, due to the high mechanical strength, toughness, and wear and fatigue resistance offered by this class of materials. Carbon steels commonly used in mooring applications include grades R3, R3S or R4, as defined by the International Association of Classification Societies (IACS-6th revision, 2016). The classification of a given carbon steel as belonging to one of these grades is based upon various characterizations of strength.

Mooring chains may be used in various aquatic environments, but some environments may be more challenging than are others from an engineering and design standpoint. Seawater environments, in particular, can place mooring chains at risk for corrosion, which may necessitate heightened attention to engineering considerations during the design stage of an offshore structure. Corrosion may be particularly problematic when it exacerbates accumulated fatigue or wear damage, but it may also be challenging in its own right even without other types of damage being present.

Both uniform thinning (i.e., general corrosion) and localized pitting may occur upon a steel mooring chain in a seawater environment. Although the design phase of a moored offshore structure may attempt to account for an anticipated rate of corrosion, it is not uncommon to find corrosion rates that are considerably higher (e.g., 2-6 times than anticipated) during field deployment. In addition, it is not straightforward to account for and/or predict pitting corrosion during the design phase, and such corrosion effects are usually not quantitatively taken into account when engineering an offshore structure. Moreover, corrosion rates may vary at different locations along the length of a mooring chain (e.g., depending upon whether a given location is submerged or in a periodic splash zone, or the particular subsurface conditions to which the mooring chain is exposed). Accordingly, a generous safety margin for anticipated mooring chain corrosion rates is generally made during the design phase of an offshore structure.

The consequences of excessive corrosion in the mooring chains of an offshore structure can be significant, both from a safety and cost standpoint. Mooring chain corrosion can be a particularly significant safety and cost issue for offshore oil and gas structures. Many moored offshore structures, such as oil platforms, can have working lifetimes measured in dozens of years, whereas their associated mooring chains may have much shorter working lifetimes due to excessive corrosion and wear, particularly when a higher than expected corrosion rate is experienced. In some cases, preemptive replacement of mooring chains may need to take place in the field in order to provide a reasonable operational safety margin. However, field replacement of mooring chains is frequently not a straightforward matter, and replacement costs can easily reach into the tens of millions of dollars or more, not including the cost of the replacement mooring chain itself. Excessive over-engineering of a mooring chain during the design phase of an offshore structure can likewise lead to an undesirable cost burden.

Although various grades of carbon steel may afford mooring chains having acceptable mechanical performance (e.g., IACS R3, R3S and R4 grades), these materials may exhibit undesirably high corrosion rates, particularly in a seawater environment. In addition, hydrogen embrittlement may sometimes be problematic for these carbon steels, both during the manufacturing phase as well as in field use. To account for excessive corrosion rates, mooring chains employing carbon steel may have significantly larger dimensions than would otherwise be required, thereby increasing material costs and chain weights. Beyond a certain size threshold, mooring chains may be difficult to fabricate with the carbon steels conventionally in use, and excessive chain weights may present an operational challenge during field deployment. In some cases, coatings have been applied to carbon steel mooring chains to address excessive corrosion rates, but the applied coatings may add undesirable cost and complexity to an offshore project. In addition, coated chains must be handled carefully during installation to avoid damaging the coating, which may be difficult to accomplish in an offshore environment.

SUMMARY

In various embodiments, the present disclosure provides mooring chains comprising: a plurality of links comprising an austenitic steel, the austenitic steel comprising: 0.4-0.8 wt. % C, 12-25 wt. % Mn, 4-15 wt. % Cr, a non-zero amount of Si<3 wt. % Si, a non-zero amount of Al<0.5 wt. % Al, a non-zero amount of N<0.1 wt. % N, <5 wt. % Mo, and balance Fe and inevitable impurities.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one of ordinary skill in the art and having the benefit of this disclosure.

DETAILED DESCRIPTION

Figure 1:
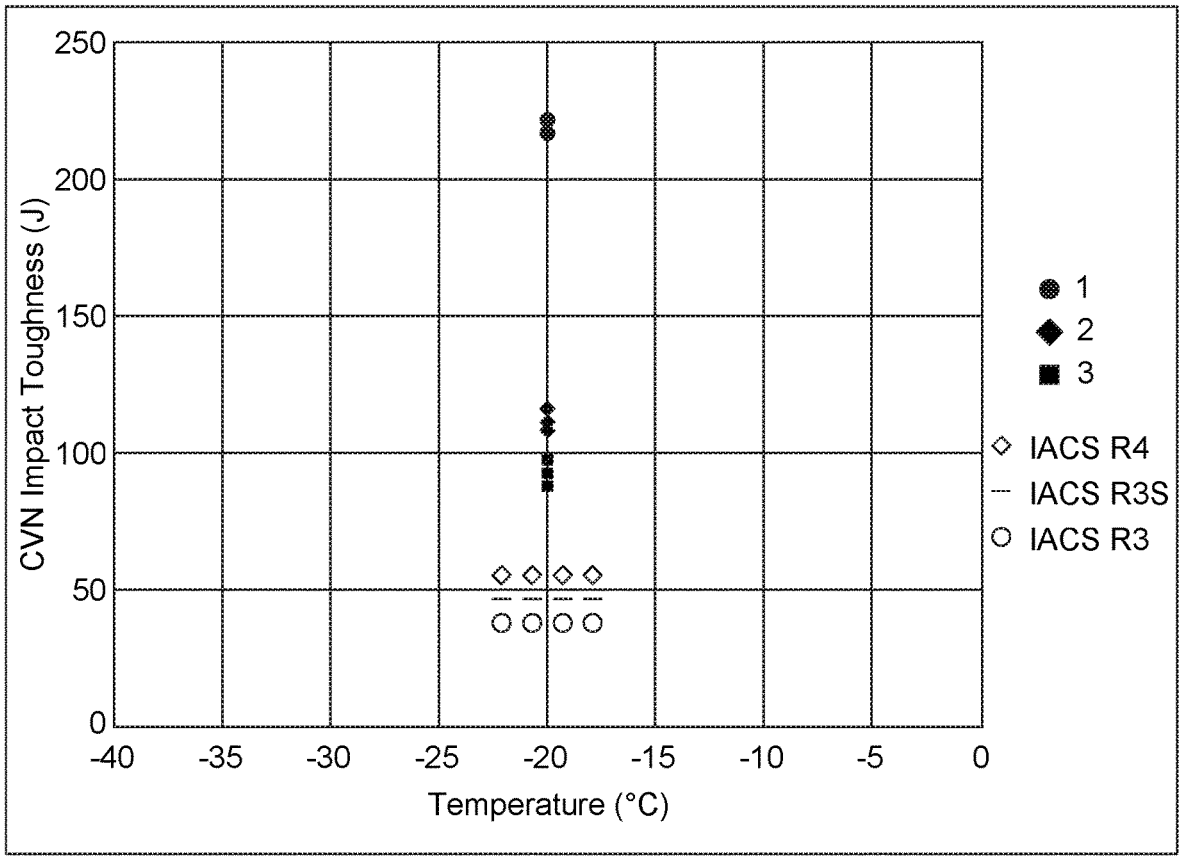
FIG. 1 shows a chart displaying Charpy V-Notch (CVN) impact toughness testing data for Alloys 1-3 of the present disclosure.

The present disclosure generally relates to austenitic steels having a good combination of mechanical properties and corrosion resistance and, more specifically, mooring chains comprising a plurality of links formed from the austenitic steels.

As discussed above, carbon steels are commonly used in applications requiring robust mechanical properties, such as in the mooring chains for floating offshore structures. Unfortunately, some carbon steels are susceptible to excessive corrosion in certain environments, such as during continuous or periodic exposure to seawater, as well as hydrogen embrittlement. Excessive corrosion of carbon steels may necessitate premature replacement of mooring chains or other steel components exposed to seawater environments, oftentimes at prohibitively high replacement costs.

The present disclosure provides austenitic steels that may be utilized to form mooring chains and other structures having advantageous properties for continuous or periodic exposure to seawater environments. Namely, the austenitic steels of the present disclosure have mechanical properties meeting or exceeding those of the carbon steels commonly used in mooring chains (e.g., IACS R3, R3S and R4 grades), as well as significantly enhanced resistance to corrosion and hydrogen embrittlement. As such, the austenitic steels disclosed herein may allow mooring chains to be fabricated such that they have longer working lifetimes in the field and/or feature smaller chain dimensions than possible with the carbon steels currently in use while maintaining a comparable engineering safety factor. Both of these features may decrease life cycle costs and/or and material costs. In addition, lower mooring chain weights may be realized to afford easier deployment in the field in some cases. Further, the austenitic steels of the present disclosure feature ready weldability using butt welding techniques commonly used for forming chain links with other types of steel. A still further advantage of the austenitic steels disclosed herein is that they are much less susceptible to hydrogen embrittlement compared to ferritic carbon steels having similar mechanical properties. The low susceptibility of the austenitic steels of the present disclosure toward hydrogen embrittlement is believed to be due to the low rate of hydrogen diffusion resulting from the austenitic microstructure, in contrast to the behavior of ferritic carbon steels having high strength. The low susceptibility toward hydrogen embrittlement allows mooring chains with higher strength to be prepared, again resulting in decreased life cycle costs and improved working lifetimes.

The austenitic steels of the present disclosure feature relatively high concentrations of manganese (Mn) to afford the foregoing combination of good mechanical properties and corrosion resistance. Such steel compositions may be referred to herein as "high-manganese steels." High-manganese steels for other applications are known for providing high tensile strength and wear performance, which has resulted in these steels historically being used for applications such as railroad frogs (common crossings) and switches, mining applications, rock crushers, and treads for tractors in abrasive environments. More recently, high-manganese steels have been developed for incorporation in slurry-carrying pipelines, such as those used in oil sands production. Advantageously, the austenitic steels of the present disclosure maintain the characteristic strength and wear resistance properties of other high-manganese steels while also exhibiting corrosion resistance through strategic incorporation of other components (alloying elements). For example, additional corrosion resistance properties may be provided to the austenitic steels of the present disclosure by the incorporation of chromium (Cr) and nitrogen (N) in concentrations and under processing conditions that do not appreciably impact the mechanical properties.

Before describing the austenitic steels of the present disclosure in further detail, a listing of terms follows to aid in better understanding the present disclosure.

All numerical values within the detailed description and the claims herein are modified by "about" or "approximately" with respect to the indicated value, and take into account experimental error and variations that would be expected by a person having ordinary skill in the art. Unless otherwise indicated, room temperature is about 25° C.

As used in the present disclosure and claims, the singular forms "a," "an," and "the" include plural forms unless the context clearly dictates otherwise.

The term "and/or" as used in a phrase such as "A and/or B" herein is intended to include "A and B," "A or B," "A", and "B."

For the purposes of the present disclosure, the new numbering scheme for groups of the Periodic Table is used. In said numbering scheme, the groups (columns) are numbered sequentially from left to right from 1 through 18, excluding the f-block elements (lanthanides and actinides).

The term "corrosion resistance" refers to a material's susceptibility to deterioration caused by exposure to a reactive or corrosive environment.

The term "toughness" refers to a material's resistance to crack initiation and propagation.

The term "yield strength" refers to a material's ability to bear a load without deformation.

The term "tensile strength" refers to the strength corresponding to the maximum load carrying capability of a material in units of stress when the failure mechanism of the material is not linear elastic fracture.

The terms "austenite" and "austenitic" refer to a steel metallurgical phase having a face-centered cubic (FCC) atomic crystalline structure.

The terms "martensite" and "martensitic" refer to a steel metallurgical phase that may be formed by diffusionless phase transformation, in which a parent steel (typically austenite) and one or more product phases have a specific orientation relationship.

The term "E-martensite" refers to a specific form of martensite having a hexagonal close-packed atomic crystalline structure which forms upon cooling or straining of an austenite phase. The ε-martensite may be formed as close-packed (111) planes of the austenite phase.

The term "α'-martensite" refers to a specific form of martensite having a body-centered cubic (BCC) or body-centered tetragonal (BCT) atomic crystalline structure which forms upon cooling or straining of an austenite phase. The α'-martensite may be formed as platelets.

The term "carbide" refers to a compound of carbon with iron or another metal.

The term "nitride" refers to a compound of nitrogen with iron or another metal.

The term "carbonitride" refers to a compound of carbon and nitrogen with iron or another metal.

Unlike ferritic carbon steels, the microstructures of the high-manganese steels disclosed herein feature an austenite phase having a face centered cubic (fcc) structure at room temperature. The austenite phase may be metastable in some instances. According to various embodiments, the austenitic steels of the present disclosure may comprise: 0.4-0.8 wt. % C, 12-25 wt. % Mn, 4-15 wt. % Cr, a non-zero amount of Si less than 3 wt. % Si, a non-zero amount of Al less than 0.5 wt. % Al, a non-zero amount of N less than 0.1 wt. % N, less than 5 wt. % Mo, and balance Fe and inevitable impurities. The term "a non-zero amount" refers to a concentration above that of a manufacturing impurity (inevitable impurities) for a particular component in the austenitic steels of the present disclosure. The non-zero amount may represent a quantity of the component that is intentionally added to a mixture when forming the austenitic steels. It is to be appreciated that the level of manufacturing impurities suitable for characterizing the concentration of a particular component as non-zero may vary for different components (elements) and from composition to composition.

Metastable austenite phases in the austenitic steels of the present disclosure can undergo a number of different phase transformations through strain induction. These transformations may include, but are not limited to, austenite phase transformation into one or more of a microtwinned (fcc) structure in which each twin is aligned with the matrix, E-martensite (hexagonal lattice), and/or α'-martensite (body centered tetragonal lattice). These transformations may depend upon the specific steel chemistry, strain conditions, and/or temperature, and the extent of metastability may vary. Strain conditions sufficient to induce such phase transformations may be encountered during manufacturing. Service conditions may also be sufficient to promote such phase transformations in some instances.

Sufficient carbon content is present in the austenitic steels of the present disclosure to stabilize the austenite phase. Carbon particularly helps in stabilizing the austenite phase during cooling from the melt and during plastic deformation. Additionally, carbon serves to strengthen the austenitic steels through solid solution strengthening. The carbon content may be chosen such that the solubility of carbon is high in the austenite phase, such as in the form of one or more soluble carbides. Insoluble carbides or free carbon may also be present in some compositions. When the carbon content is too high, significant carbide precipitation can occur during processing and high temperature thermal cycles during chain fabrication. Excessive carbide formation may reduce toughness. For the foregoing reasons, the carbon content in the austenitic steels of the present disclosure may range from about 0.4-0.8 wt. % C. In more specific embodiments, the austenitic steels of the present disclosure may comprise from about 0.5-0.7 wt. % C or from about 0.55-0.65 wt. % C.

Manganese is the primary alloying element in high-manganese steels, such as the austenitic steels disclosed herein. Manganese may particularly aid in stabilizing the austenitic phase during cooling and deformation of the austenitic steels. Additionally, the amount of manganese may determine how the austenitic steels respond or transform when strained. At manganese contents greater than about 25 wt. %, the austenite phase may deform via dislocation slip when it is mechanically strained. At manganese contents between about 15 wt. % and about 25 wt. %, the austenite phase is mildly metastable and may undergo twinning during deformation. The twinning may result in a high degree of work hardening and can produce very high tensile strength and uniform elongation. At manganese contents less than about 15 wt. %, the austenite phase is more metastable (less stable) and can transform into an ε-martensite and/or α'-martensite phase upon mechanical straining. A combination of twinning and transformation to c-martensite may provide a favorable combination of mechanical behavior (strength, toughness, wear resistance, corrosion resistance) for mooring chain applications. For the foregoing reasons, the manganese content in the austenitic steels of the present disclosure may range from about 12-25 wt. % Mn. In more specific embodiments, the austenitic steels of the present disclosure may comprise from about 12-18 wt. % Mn, or from about 14-19 wt. % Mn, or from about 16-20 wt. % Mn. In some embodiments, in addition to a predominant austenite phase, the austenitic steels of the present disclosure may comprise a twinned phase and/or ε-martensite.

The chromium content in the austenitic steels of the present disclosure may particularly aid in facilitating corrosion resistance. The chromium content may be limited based upon one or more of the following considerations: (1) limiting steel costs by avoiding Cr levels that are too high, (2) limiting austenite phase destabilization for Cr levels that are too high, thereby encouraging ferrite phase formation, and (3) limiting carbide precipitation (and possible toughness loss) during processing and high-temperature thermal cycling for Cr levels that are too high. The chromium content is therefore chosen to convey acceptable corrosion resistance to the austenitic steels without promoting excessive austenite phase destabilization or carbide precipitation. For the foregoing reasons, the chromium content in the austenitic steels of the present disclosure may range from about 4-15 wt. % Cr. In more specific embodiments, the austenitic steels of the present disclosure may comprise from about 5-10 wt. % Cr, or from about 10-15 wt. % Cr.

The silicon content in the austenitic steels of the present disclosure may play one or more of the following roles: serving as a ferrite stabilizer, promoting ε-martensite formation during ambient temperature deformation, and strengthening the austenite phase through solid solution strengthening. The silicon content may be limited to promote sufficient strengthening without inducing excessive ferrite stabilization. For the foregoing reasons, the silicon content in the austenitic steels of the present disclosure may be present in a non-zero amount up to about 3 wt. % Si. In more specific embodiments, the austenitic steels of the present disclosure may comprise a non-zero amount of silicon up to about 1 wt. % Si. In still more specific embodiments, the austenitic steels of the present disclosure may comprise an amount of silicon ranging from about 0.01 wt. % Si to about 3 wt. % Si, or from about 0.01 wt. % Si to about 1 wt. % Si, or from about 0.01 wt. % Si to about 0.2 wt. % Si.

Aluminum is a ferrite stabilizer, and significant amounts of aluminum can destabilize the austenite phase during cooling. At lower levels, however, aluminum can stabilize the austenite phase to some degree in the austenitic steels of the present disclosure. Stabilization may include action against strain-induced phase transformation taking place during deformation and providing a small amount of solid solution strengthening. For the foregoing reasons, the aluminum content in the austenitic steels of the present disclosure may be present in a non-zero amount up to about 0.5 wt. % Al. In more specific embodiments, the austenitic steels of the present disclosure may comprise a non-zero amount of aluminum up to about 0.1 wt. % Al or up to about 0.08 wt. % Al. In still more specific embodiments, the austenitic steels of the present disclosure may comprise an amount of aluminum ranging from about 0.001 wt. % Al to about 0.5 wt. % Al, or from about 0.001 wt. % Al to about 0.1 wt. % Al, or from about 0.001 wt. % Al to about 0.08 wt. % Al.

Molybdenum is a very effective solid solution strengthener of the austenite phase in the austenitic steels of the present disclosure and may be utilized in small quantities to increase strength. Depending on strength requirements for a mooring chain, the inclusion of molybdenum in the austenitic steel forming the mooring chain may be optional. For the foregoing reasons, according to some embodiments, the molybdenum content in the austenitic steels of the current disclosure may be present in an amount up to about 5 wt. %. The austenitic steels may be substantially molybdenum-free (<0.001 wt. % Mo as a trace impurity) in some embodiments. In more specific embodiments in which molybdenum is present, the austenitic steels of the present disclosure may comprise a non-zero amount of molybdenum up to about 5 wt. %, or up to about 1 wt. %, or up to about 0.5 wt. %, or up to about 0.1 wt. %. In still more specific embodiments, the austenitic steels of the present disclosure may comprise an amount of molybdenum ranging from about 0.001 wt. % Mo to about 5 wt. % Mo, or from about 0.001 wt. % Mo to about 1 wt. % Mo, or from about 0.001 wt. % Mo to about 0.5 wt. % Mo, or from about 0.001 wt. % Mo to about 0.1 wt. % Mo. In other embodiments, the austenitic steels of the present disclosure may comprise between about 0-5 wt. % molybdenum, with the inclusion of molybdenum being optional. In more specific examples, the austenitic steels of the present disclosure may comprise about 0-5 wt. % Mo, or about 0-1 wt. % Mo, or about 0-0.5 wt. % Mo, or about 0-0.1 wt. % Mo.

Nitrogen is an effective solid solution strengthener and a precipitate (nitride) former. In Cr, and Mn alloyed austenitic steels, the nitrogen solubility limit is typically determined by the equilibrium between the matrix and chromium nitride (e.g., $Cr_2N$). When the nitrogen concentration is above the solubility limit, the alloyed steel is susceptible to chromium nitride precipitation, especially at temperatures between approximately 500° C. and 1100° C. The kinetics of precipitation are highly composition- and temperature-dependent. The effectiveness of nitrogen as a strengthener is such that if the nitrogen content is too high, hot workability (required for manufacturing) of the austenitic steel may be negatively impacted. For the foregoing reasons, the nitrogen content in the austenitic steels of the current disclosure may be present in a non-zero amount up to about 0.1 wt. % N. In more specific embodiments, the austenitic steels of the present disclosure may comprise a non-zero amount of nitrogen up to about 0.05 wt. % N, or up to about 0.01 wt. % N, or up to 0.008 wt. % N. In still more specific embodiments, the austenitic steels of the present disclosure may comprise an amount of nitrogen ranging from about 0.001 wt. % N to about 0.1 wt. % N, or from about 0.001 wt. % N to about 0.05 wt. % N, or from about 0.001 wt. % N to about 0.01 wt. % N, or from about 0.001 wt. % N to about 0.008 wt. % N. Nitrogen may also lessen corrosion, particularly pitting corrosion, in the austenitic steels. Without being bound by any theory or mechanism, it is believed that the corrosion protection afforded by nitrogen may be due to its influence in stabilizing passivating oxide films and promoting rapid re-passivation in local areas where a passivating oxide film has been disrupted.

Accordingly, mooring chains comprising the austenitic steels described hereinabove may comprise a plurality of links comprising an austenitic steel, which comprises:

0.4-0.8 wt. % C,
12-25 wt. % Mn,
4-15 wt. % Cr,
a non-zero amount of Si<3 wt. % Si,
a non-zero amount of Al<0.5 wt. % Al,
a non-zero amount of N<0.1 wt. % N,
<5 wt. % Mo, and
balance Fe and inevitable impurities.

According to more specific embodiments, mooring chains of the present disclosure may comprise an austenitic steel comprising carbon in an amount ranging from about 0.5-0.7 wt. % C or from about 0.55-0.65 wt. % C. In more specific embodiments, the foregoing amounts of carbon may be present in the austenitic steel in combination with about 12-25 wt. % Mn, about 4-15 wt. % Cr, a non-zero amount of Si less than about 3 wt. % Si, a non-zero amount of Al less than about 0.5 wt. % Al, a non-zero amount of Mo less than about 5 wt. % Mo or an amount of Mo less than about 5 wt. % Mo, and a non-zero amount of N less than about 0.1 wt. % N, including any sub-range within the foregoing amounts of Mn, Cr, Si, Al, Mo, and N.

According to some more specific embodiments, mooring chains of the present disclosure may comprise an austenitic steel comprising manganese in an amount ranging between about 16-20 wt. %. In more specific embodiments, the foregoing amounts of manganese may be present in the austenitic steel in combination with about 0.4-0.8 wt. % C, about 4-15 wt. % Cr, a non-zero amount of Si less than about 3 wt. % Si, a non-zero amount of Al less than about 0.5 wt. % Al, a non-zero amount of Mo less than about 5 wt. % Mo or an amount of Mo less than about 5 wt. % Mo, and a non-zero amount of N less than about 0.1 wt. % N, including any sub-range within the foregoing amounts of C, Cr, Si, Al, Mo, and N.

According to some more specific embodiments, mooring chains of the present disclosure may comprise an austenitic steel comprising about 5-10 wt. % Cr, or about 8-15 wt. % Cr. In more specific embodiments, the foregoing amounts of chromium may be present in the austenitic steel in combination with about 0.4-0.8 wt. % C, about 12-25 wt. % Mn, a non-zero amount of Si less than about 3 wt. % Si, a non-zero amount of Al less than about 0.5 wt. % Al, a non-zero amount of Mo less than about 5 wt. % Mo or an amount of Mo less than about 5 wt. % Mo, and a non-zero amount of N less than about 0.1 wt. % N, including any sub-range within the foregoing amounts of C, Mn, Si, Al, Mo, and N.

According to some more specific embodiments, mooring chains of the present disclosure may comprise an austenitic steel comprising a non-zero amount of silicon less than about 3 wt. % Si or less than about 1 wt. % Si. In more specific embodiments, the foregoing amounts of silicon may be present in the austenitic steel in combination with about 0.4-0.8 wt. % C, about 12-25 wt. % Mn, about 4-15 wt. % Cr, a non-zero amount of Al less than about 0.5 wt. % Al, a non-zero amount of Mo less than about 5 wt. % Mo or an amount of Mo less than about 5 wt. % Mo, and a non-zero amount of N less than about 0.1 wt. % N, including any sub-range within the foregoing amounts of C, Mn, Cr, Al, Mo, and N.

According to some more specific embodiments, mooring chains of the present disclosure may comprise an austenitic steel comprising a non-zero amount of aluminum less than about 0.5 wt. % Al or a non-zero amount of aluminum less than about 0.08 wt. % Al. In more specific embodiments, the foregoing amounts of aluminum may be present in the austenitic steel in combination with about 0.4-0.8 wt. % C, about 12-25 wt. % Mn, about 4-15 wt. % Cr, a non-zero amount of Si less than about 3 wt. % Si, a non-zero amount of Mo less than about 5 wt. % Mo or an amount of Mo less than about 5 wt. % Mo, and a non-zero amount of N less than about 0.1 wt. % N, including any sub-range within the foregoing amounts of C, Mn, Cr, Si, Mo, and N.

According to some more specific embodiments, mooring chains of the present disclosure may comprise an austenitic steel comprising a non-zero amount of molybdenum less than about 5 wt. % Mo or an amount of Mo less than about 5 wt. % Mo. In more specific embodiments, the foregoing amounts of molybdenum may be present in the austenitic steel in combination with about 0.4-0.8 wt. % C, about 12-25 wt. % Mn, about 4-15 wt. % Cr, a non-zero amount of Si less than about 3 wt. % Si, a non-zero amount of Al less than about 0.5 wt. % Al, and a non-zero amount of N less than about 0.1 wt. % N, including any sub-range within the foregoing amounts of C, Mn, Cr, Si Al, and N.

According to some more specific embodiments, mooring chains of the present disclosure may comprise an austenitic steel comprising a non-zero amount of nitrogen less than about 0.1 wt. % N, or a non-zero amount of nitrogen less than about 0.008 wt. % N. In more specific embodiments, the foregoing amounts of nitrogen may be present in the austenitic steel in combination with about 0.4-0.8 wt. % C, about 12-25 wt. % Mn, about 4-15 wt. % Cr, a non-zero amount of Si less than about 3 wt. % Si, a non-zero amount of Al less than about 0.5 wt. % Al, and a non-zero amount of Mo less than about 5 wt. % Mo or an amount of Mo less than about 5 wt. % Mo, including any sub-range within the foregoing amounts of C, Mn, Cr, Si, Al, and Mo.

Moreover, in any of the foregoing austenitic steels, the austenitic steel may comprise at least 0.01 wt. % Si, at least 0.001 wt. % Al, and at least 0.001 wt. % N. Optionally, at least 0.001 wt. % Mo may also be present.

In various embodiments, mooring chains comprising the austenitic steels of the present disclosure may feature a grain size ranging from about 20 microns to about 200 microns, or any subrange thereof.

Mooring chains of the present disclosure may feature an austenitic steel having one or more of the following physical properties: a yield strength of at least 440 MPa and an ultimate tensile strength of at least about 990 MPa, a corrosion rate ranging at 25° C. and 1 bar pressure of about 0.2 mils per year (mpy) to about 0.7 mpy, is Charpy notch impact toughness at −20° C. of about 80 J to about 220 J, and an ASTM G99 wear value characterized by an average pin loss measurement of about 2 mg or less and an average disk mass loss measurement of 8 mg or less.

According to some embodiments, mooring chains of the present disclosure may feature links that are joined together using butt welding techniques. Both studded and studless links may be formed.

In some embodiments, mooring chains of the present disclosure may be adapted for exposure to multiple conditions. In particular, such mooring chains may feature chain links in a first section adapted for continuous or near-continuous exposure to seawater and chain lengths in a second section adapted for limited or no exposure to seawater, wherein the chain lengths in each section may comprise different steel compositions. In more specific embodiments, such mooring chains may comprise a top chain coupled to a bottom chain, in which the top chain resides above an anticipated water line or splash zone in a moored offshore structure and the bottom chain resides in a splash zone or below an anticipated water line of the moored offshore structure. In such mooring chains, the top chain may comprise a ferritic carbon steel and the bottom chain may comprise an austenitic steel of the present disclosure. In other embodiments, the top chain and the bottom chain may comprise austenitic steels of the present disclosure, each having different compositions. In still other embodiments, the top chain may comprise an austenitic steel of the present disclosure, and the bottom chain may comprise a ferritic carbon steel. The austenitic steels of the present disclosure may be particularly advantageous as a top chain that is periodically exposed to water and/or is in a region a few meters below the water line. Steels in the foregoing regions (e.g., in splash zones or just below the water line) may be especially susceptible to corrosion, which may be mitigated through use of the austenitic steels described herein.

In addition to mooring chains comprising the austenitic steels disclosed herein, the present disclosure also contemplates other structures comprising the austenitic steels that may be continuously or periodically in contact with a seawater environment. Such structures may include, for example, platform legs, risers, boat hulls, pipelines, and the like.

The present disclosure also provides moored offshore structures that are held in place by one or more mooring chains of the present disclosure. Any of the austenitic steels disclosed herein may be used for forming mooring chains suitable for securing a particular type of floating offshore structure. Illustrative floating offshore structures that may be held in place with the mooring chains of the present disclosure include, for example, oil drilling and production platforms, buoys, floating storage and offloading vessels (FSO-vessels), drilling ships, offshore wind turbines, and the like. Choice of a mooring chain suitable for a given application may depend upon the type of floating offshore structure being moored, and the particular environmental conditions present at the site of mooring.

In some or other more specific embodiments, the mooring chains of the present disclosure may be prepared from an austenitic steel that has been processed using a hot rolling procedure that comprises: hot rolling the austenitic steel in a series of hot rolling cycles, each cycle having a progressively decreasing temperature, thereby forming an austenitic steel sheet; wherein the austenitic steel sheet is decreased in thickness by about 10% to about 25% during each hot rolling cycle; and after a final hot rolling cycle, cooling the austenitic steel sheet to room temperature under a water curtain. The austenitic steel provided to the first hot rolling cycle may be in the form of an austenitic steel ingot.

The mooring chains disclosed herein can be particularly useful in securing a floating offshore structure by transferring loading forces imposed upon the floating offshore structure, through the mooring chain, and to a rigid pile anchor which is secured to the earthen surface below the body of water. The mooring chain may be a component part of a flexible connection connecting the floating offshore structure to the rigid pile anchor are may be the sole component of the flexible connection. The mooring chains herein are particularly useful in reducing corrosion rates experienced due to stresses imposed on the mooring chain, particularly in a sea water environment and/or wherein the mooring chain is located is located in a periodic splash zone, wherein the portion of the mooring chain is periodically submerged under the body of water and periodically exposed to air above the body of water. In this splash zone, the austenitic steel of the mooring chains can have a corrosion rate of about 0.2 to about 0.7 mils per year (mpy). The mooring chains herein may be to be utilized as bare (i.e., no coatings applied to the chain) in service and maintain very low material loss due to corrosive effects.

Embodiments disclosed herein include: A. Mooring chains. The mooring chains comprise: a plurality of links comprising an austenitic steel, the austenitic steel comprising:

0.4-0.8 wt. % C,
12-25 wt. % Mn,
4-15 wt. % Cr,
a non-zero amount of Si<3 wt. % Si,
a non-zero amount of Al<0.5 wt. % Al,
a non-zero amount of N<0.1 wt. % N,
<5 wt. % Mo, and
balance Fe and inevitable impurities.

Embodiment A may have one or more of the following additional elements in any combination:

Element 1: wherein the austenitic steel comprises a non-zero amount of Si<1 wt. % Si.

Element 2: wherein the austenitic steel comprises 0.5-0.7 wt. % C.

Element 3: wherein the austenitic steel comprises 0.55-0.65 wt. % C.

Element 4: wherein the austenitic steel comprises 16-20 wt. % Mn.

Element 5: wherein the austenitic steel comprises a non-zero amount of Al<0.08 wt. % Al.

Element 6: wherein the austenitic steel comprises a non-zero amount of N<0.008 wt. % N.

Element 7: wherein the austenitic steel comprises at least 0.01 wt. % Si, at least 0.001 wt. % Al, and at least 0.001 wt. % N.

Element 8: wherein the austenitic steel comprises 5-10 wt. % Cr.

Element 9: wherein the austenitic steel comprises 8-15 wt. % Cr.

Element 10: wherein the austenitic steel comprises a non-zero amount of Mo<5 wt. % Mo.

Element 11: wherein the austenitic steel has a yield strength of at least about 440 MPa and an ultimate tensile strength of at least about 990 MPa.

Element 12: wherein the austenitic steel has a corrosion rate at 25° C. and 1 bar pressure of about 0.2 to about 0.7 mils per year (mpy).

Element 13: wherein the austenitic steel has a Charpy notch impact toughness at −20° C. of about 80 J to about 220 J.

Element 14: wherein the austenitic steel has an ASTM G99 wear value characterized by an average pin loss measurement of 2 mg or less and an average disk mass loss measurement of 8 mg or less.

Element 15: wherein each link is butt welded together.

Element 16: wherein the mooring chain comprises a top chain coupled to a bottom chain, the top chain configured for residing above an anticipated water line and the bottom chain configured for residing below an anticipated water line, the top chain and the bottom chain differing compositionally from one another and at least one of the top chain and the bottom chain comprising the austenitic steel.

Element 17: wherein the austenitic steel is processed by a hot rolling procedure, the hot rolling procedure comprising: hot rolling a steel ingot in a series of hot rolling cycles, each cycle having a progressively decreasing temperature, thereby forming an austenitic steel sheet; wherein the austenitic steel sheet is decreased in thickness by about 10% to about 25% during each hot rolling cycle; and after a final hot rolling cycle, cooling the austenitic steel sheet to room temperature under a water curtain.

By way of non-limiting example, exemplary combinations include: The mooring chain of A in combination with elements 1 and 10; 2 and 10; 3 and 10; 4 and 10; 5 and 10; 6 and 10; 7 and 10; 8 and 10; 9 and 10; 10 and 11; 10 and 12; 10 and 13; 10 and 14; 10 and 15; 10 and 16; and 10 and 17. The mooring chain of A in combination with elements 1 and 2; 1 and 3; 1 and 4; 1 and 5; 1 and 6; 1 and 7; 1 and 8; 1 and 9; 1 and 11; 1 and 12; 1 and 13; 1 and 14; 1 and 15; 1 and 16; 1 and 17; 2 and 4; 2 and 5; 2 and 6; 2 and 7; 2 and 8; 2 and 9; 2 and 11; 2 and 12; 2 and 13; 2 and 14; 2 and 15; 2 and 16; 2 and 17; 3 and 5; 3 and 6; 3 and 7; 3 and 8; 3 and 9; 3 and 11; 3 and 12; 3 and 13; 3 and 14; 3 and 15; 3 and 16; 3 and 17; 4 and 5; 4 and 6; 4 and 7; 4 and 8; 4 and 9; 4 and 11; 4 and 12; 4 and 13; 4 and 14; 4 and 15; 4 and 16; 4 and 17; 5 and 6; 5 and 7; 5 and 8; 5 and 9; 5 and 11; 5 and 12; 5 and 13; 5 and 14; 5 and 15; 5 and 16; 5 and 17; 6 and 7; 6 and 8; 6 and 9; 6 and 11; 6 and 12; 6 and 13; 6 and 14; 6 and 15; 6 and 16; 6 and 17; 7 and 8; 7 and 9; 7 and 11; 7 and 12; 7 and 13; 7 and 14; 7 and 15; 7 and 16; 7 and 17; 8 and 11; 8 and 12; 8 and 13; 8 and 14; 8 and 15; 8 and 16; 8 and 17; 9 and 11; 9 and 12; 9 and 13; 9 and 14; 9 and 15; 9 and 16; 9 and 17; 11 and 12; 11 and 13; 11 and 14; 11 and 15; 11 and 16; 11 and 17; 12 and 13; 12 and 14; 12 and 15; 12 and 16; 12 and 17; 13 and 14; 13 and 15; 13 and 16; 13 and 17; 14 and 15; 14 and 16; 14 and 17; 15 and 16; 15 and 17; and 16 and 17, any of which may be in further combination with element 10. The mooring chain of A in combination with elements 1, 2 and 4; 1, 2 and 5; 1, 2 and 6; 1, 2 and 7; 1, 2 and 8; 1, 2 and 9; 1, 2 and 10; 2, 4 and 5; 2, 4 and 6; 2, 4, 5 and 6; 2, 4, 5 and 7; 2, 4-6 and 7; 2, 4, 5 and 8; 2, 4, 5 and 9; 2, 4, 6 and 9; 2, 4-6 and 8; 2, 4-6 and 9; 2, 4 and 5-8; 2, 4, 5-7 and 9; 2, 5 and 6; 2, 5 and 7; 2 and 5-7; 2, 5-7 and 8; 2, 5-7 and 9; 2, 6 and 7; 2 and 6-8; 2, 6, 7 and 9; 2, 7 and 8; 2, 7 and 9; 4-6; 4, 5 and 7; 4-7; 4, 5 and 8; 4, 5 and 9; 4, 5, 7 and 8; 4, 5, 7 and 9; 4, 6 and 7; 4, 6 and 8; 4, 6 and 9; 4 and 6-8; 4, 6, 7 and 9; 5-7; 5-8; 5-7 and 9; 6-8; and 6, 7 and 9, any of which may be in further combination with element 10 and/or in further combination with one or more of elements 11, 12, 13, 14, 15, 16 or 17. The mooring chain of A in combination with elements 7, 8 and 10; and 7, 9 and 10, any of which may be in further combination with one or more of elements 11, 12, 13, 14, 15, 16 or 17. The mooring chain of A in combination with elements 1, 2, 4-6, 8 and 11; 1, 2, 4-6, 8 and 12; 1, 2, 4-6, 8 and 13; 1, 2, 4-6, 8 and 14; 2, 4-6, 8 and 11; 2, 4-6, 8 and 12; 2, 4-6, 8 and 13; 2, 4-6, 8 and 14; 2, 4-6, 9 and 11; 2, 4-6, 9 and 12; 2, 4-6, 9 and 13; and 2, 4-6, 9 and 14, any of which may be in further combination with element 10.

To facilitate a better understanding of the embodiments described herein, the following examples of various representative embodiments are given. In no way should the following examples be read to limit, or to define, the scope of the present disclosure.

EXAMPLES

Steels alloys were formulated as specified in Table 1. Processing of alloys 1-3 was performed by ingot casting followed by hot rolling. Alloys 4 and 5 were obtained from carbon steel mooring chains that were manufactured by bar forging and hot forming.

TABLE 1

| Alloy | C | Si | Mn | Al | Cr | Mo | N | Ni | Co |
|---|---|---|---|---|---|---|---|---|---|
| 1 | 0.6 | 0.109 | 18.6 | 0.059 | 5.09 | — | 0.0072 | — | — |
| 2 | 0.591 | 0.098 | 18.084 | 0.059 | 10.269 | — | 0.0076 | — | — |
| 3 | 0.562 | 2.871 | 16.77 | 0.051 | 5.259 | — | 0.005 | — | — |
| 4 (Comparative) | 0.096 | — | 1.6 | — | 1.0 | 0.35 | — | 1.0 | 0.6 |
| 5 (Comparative) | <0.2 | — | 2.6 | — | 0.36 | — | — | 0.57 | 0.6 |

The inventive steel alloys were initially produced in a 5 inch thick ingot form. The initially produced ingot was hot rolled in progressively decreasing temperature steps between 1150° C. and 843° C., with a thickness reduction of 15-20% taking place at each hot rolling stage. Table 2 shows a representative schedule of the hot rolling conditions at each stage.

TABLE 2

| Pass # | Pre-Step Temperature (° C.) | PreStep Thickness (in.) | Post Step Thickness (in.) | Reduction (%) |
|---|---|---|---|---|
| Reheating | 1150 | — | — | — |
| 1 | 1121 | 5.00 | 4.25 | 15 |
| 2 | 1079 | 4.25 | 3.61 | 15 |
| 3 | 1038 | 3.61 | 3.07 | 15 |
| 4 | 1010 | 3.07 | 2.46 | 20 |
| 5 | 982 | 2.46 | 1.97 | 20 |
| 6 | 954 | 1.97 | 1.57 | 20 |
| 7 | 927 | 1.57 | 1.26 | 20 |
| 8 | 885 | 1.26 | 1.01 | 20 |
| 9 | 843 | 1.01 | 0.80 | 20 |
| Quench | Cooling to room temperature starts immediately after finishing the rolling operation and takes place under a water curtain. | | | |

The yield and tensile strengths of the steel alloys shown in Table 1 were evaluated under standard conditions using ASTM E8 testing methods at room temperature. Testing results are shown in Table 3. Yield and tensile strengths for IACS steel grades R3, R3S and R4 are also included in Table 3 for reference. The values represent the range of two tested samples.

TABLE 3

| Alloy | Yield Strength (MPa) | Ultimate Tensile Strength (MPa) |
|---|---|---|
| 1 | 441 | 993-1020 |
| 2 | 607-621 | 1076-1082 |
| 3 | 569-593 | 1117-1131 |
| 4 (Comparative) | 446-494 | 674-707 |
| 5 (Comparative) | 588-623 | 717-750 |
| IACS R3 Grade | >410 | >690 |
| IACS R3S Grade | >490 | >770 |
| IACS R4 Grade | >580 | >860 |

As shown in Table 3, Alloy 1 and Comparative Alloy 4 had comparable yield strength values, but Alloy 1 had a significantly greater ultimate tensile strength. Alloys 2 and 3 likewise had comparable yield strengths to Comparative Alloy 5 but significantly greater ultimate tensile strength values. The yield strength values for Alloys 1-3 spanned the range of yield strengths for IACS Grade R3, R3S and R4. The high yield strength values are believed to be due to solid solution strengthening of the austenite phase in the steel alloys disclosed herein. The ultimate tensile strength values of Alloys 1-3 were also all significantly greater than those exhibited by the IACS alloys. The high ultimate tensile strength values exhibited by Alloys 1-3 are indicative of work hardenability, which is beneficial in mooring chain applications. The work hardenability is believed to be due to micro-twinning and E-martensite formation upon plastic deformation.

FIG. 1 shows a chart displaying Charpy V-Notch (CVN) impact toughness testing data for Alloys 1-3 of the present disclosure. Testing was conducted under standard conditions using ASTM A370 testing method at −20° C. As shown, the CVN impact toughness was greatest for Alloy 1. In addition, Alloys 1-3 all exhibited CVN impact toughness values greater than those shown by the IACS alloys. The chart also shows the (CVN) impact toughness testing data for IACS Grades R3, R3S and R4 for comparison.

Figure 2:
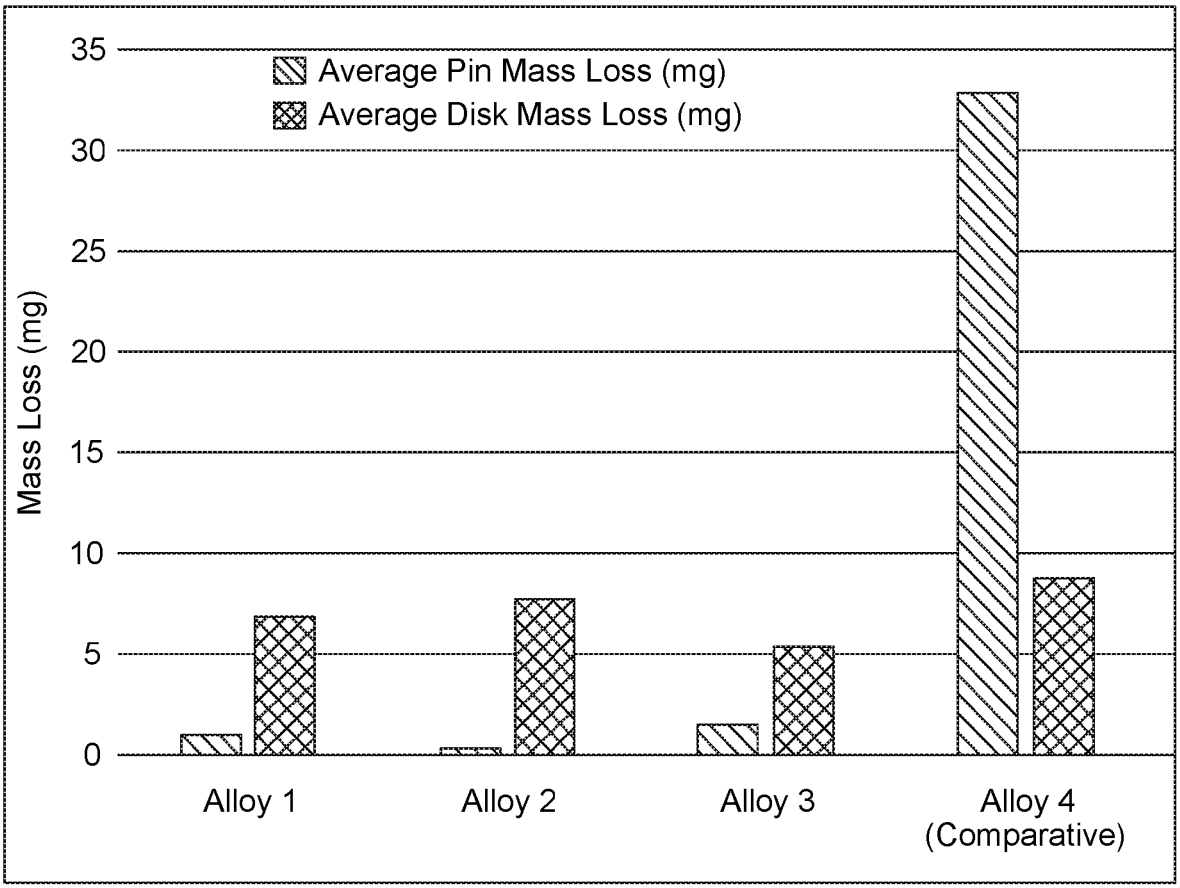
FIG. 2 shows a chart displaying ASTM G99 pin and disk average mass loss measurements for Alloys 1-3 of the present disclosure and Comparative Alloy 4 in a synthetic seawater environment.

FIG. 2 shows a chart displaying ASTM G99 pin and disk average mass loss measurements for Alloys 1-3 of the present disclosure and Comparative Alloy 4 in a synthetic seawater environment (ASTM D1141 synthetic seawater). The pin and disk mass loss measurements are characteristic of wear performance upon field deployment. As shown, Alloys 1-3 all exhibited much smaller mass losses on both the pin and the disk portions relative to Comparative Alloy 4 under the standard testing conditions. The pin mass loss portion for Alloys 1-3 was much smaller than the disk mass loss portion. In contrast, Comparative Alloy 4 exhibited a pin mass loss portion that was much higher than the disk mass loss portion. The small pin mass loss portion of Alloys 1-3 is believed to be due to surface work hardening taking place upon the pin throughout the test.

Figure 3:
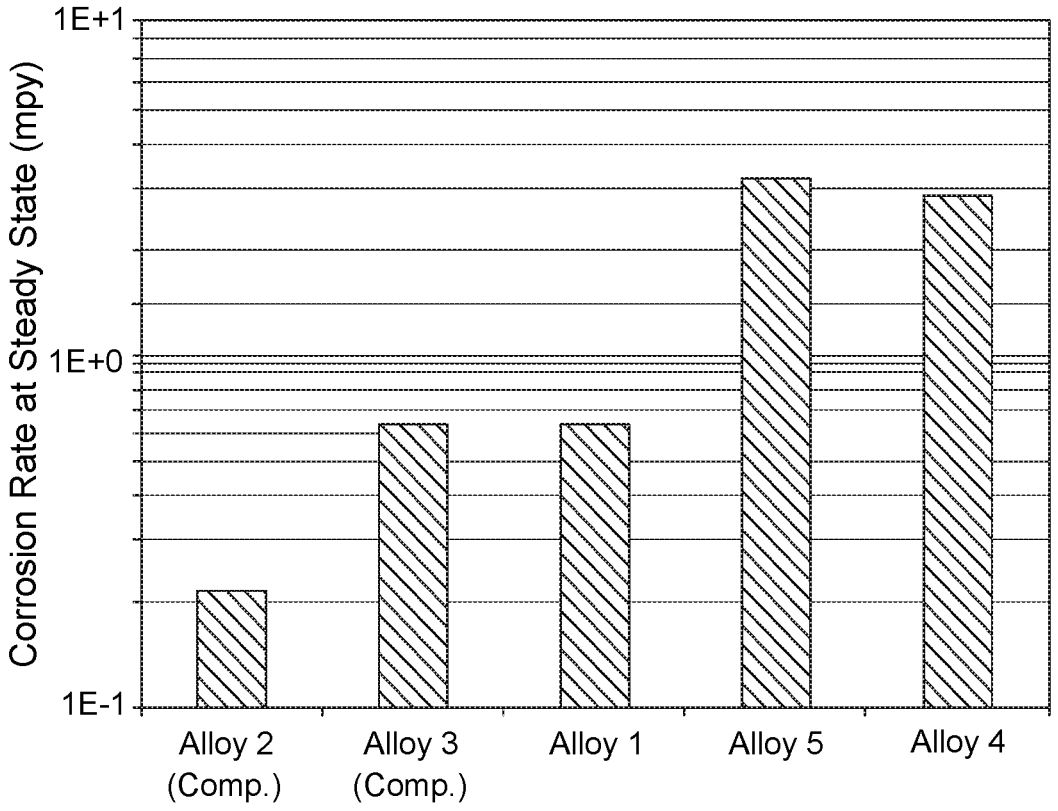
FIG. 3 shows a chart displaying steady state corrosion data for Alloys 1-3 of the present disclosure and Comparative Alloys 4 and 5 in a synthetic seawater environment.
Figure 4A:
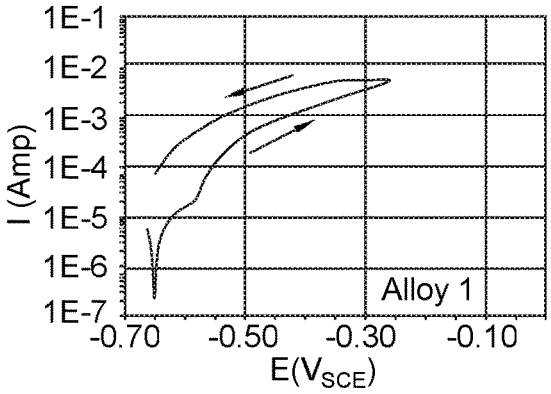
FIGS. 4A-4E show corresponding cyclic polarization curves for Alloys 1-3 of the present disclosure and Comparative Alloys 4 and 5 in a synthetic seawater environment.
Figure 4B:
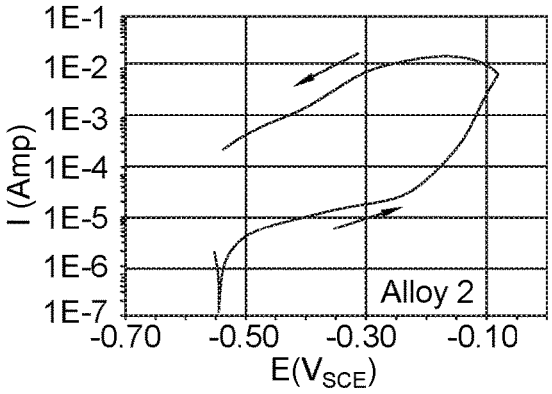
Figure 4C:
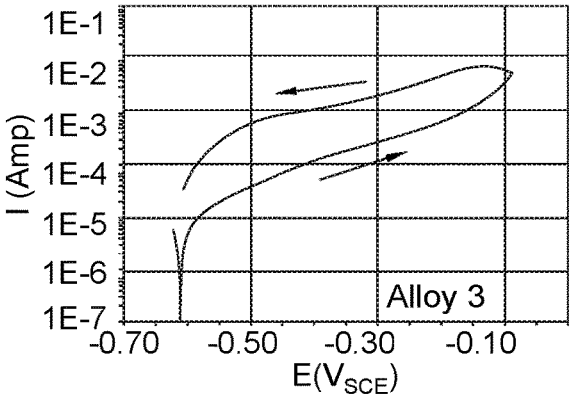
Figure 4D:
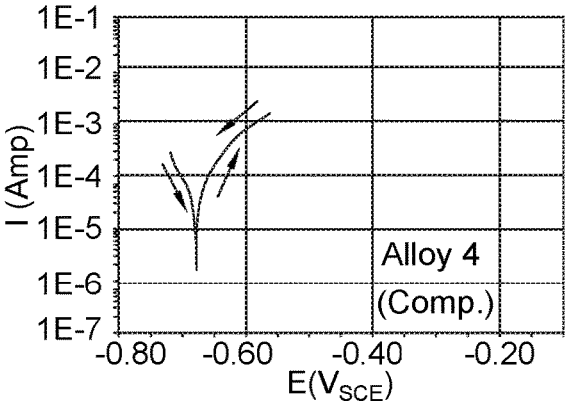
Figure 4E:
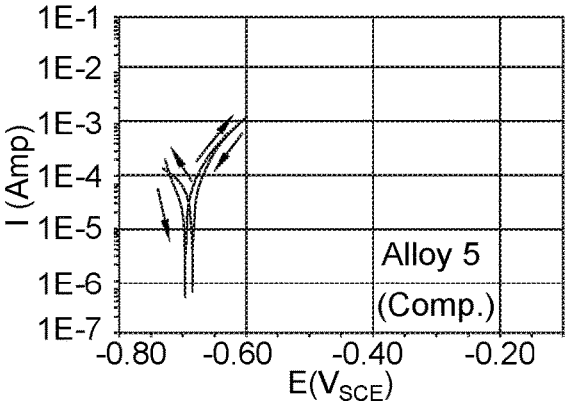

FIG. 3 shows a chart displaying steady state corrosion data for Alloys 1-3 of the present disclosure relative to Comparative Alloys 4 and 5 in a synthetic seawater environment at 25° C. and 1 bar pressure. The testing duration was one week. The synthetic seawater had the following composition: NaCl (26.25 g/L), KCl (0.6 g/L), $CaCl_2.2H_2O$ (1.5 g/L), $MgCl_2.6H_2O$ (5.7 g/L), $MgSO_4.7H_2O$ (6.75 g/L) and $NaHCO_3$ (0.17 g/L). As shown, Alloys 1-3 exhibited significantly different steady state corrosion rates relative to Comparative Alloys 4 and 5. The corrosion rates for Alloys 1-3 varied from 0.2-0.7 mils per year (mpy), in comparison to rates of 3.0-3.5 mpy for Comparative Alloys 4 and 5. Alloy 2, which contained a higher percentage of Cr, exhibited better corrosion resistance than did Alloys 1 and 3, whose Cr contents were lower.

FIGS. 4A-4E show corresponding cyclic polarization curves for Alloys 1-3 and Comparative Alloys 4 and 5 in a synthetic seawater environment. Testing was conducted as above. The narrow cyclic polarization curves for Comparative Alloys 4 and 5 (FIGS. 4D and 4E) relative to the wider cyclic polarization curves of Alloys 1-3 (FIGS. 4A-4C) showed that Alloys 1-3 were more corrosion resistant. In addition, the polarization curves for Alloys 1-3 showed some signs of protective passivation behavior, whereas the polarization curves for Comparative Alloys 4 and 5 did not.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

One or more illustrative embodiments are presented herein. Not all features of a physical implementation are described or shown in this application for the sake of clarity. It is understood that in the development of a physical embodiment of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for one of ordinary skill in the art and having benefit of this disclosure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to one having ordinary skill in the art and having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein.

What is claimed is:

1. A mooring chain comprising:

a plurality of links comprising an austenitic steel, the austenitic steel comprising:
0.4-0.8 wt. % C,
12-25 wt. % Mn,
4-15 wt. % Cr,
a non-zero amount of Si<3 wt. % Si,
a non-zero amount of Al<0.5 wt. % Al,
a non-zero amount of N<0.1 wt. % N,
<5 wt. % Mo, and
balance Fe and inevitable impurities;

wherein the austenitic steel has a corrosion rate at 25° C. and 1 bar pressure of about 0.2 to about 0.7 mils per year (mpy).

2. The mooring chain of claim 1, wherein the austenitic steel comprises a non-zero amount of Si<1 wt. % Si.

3. The mooring chain of claim 1, wherein the austenitic steel comprises 0.55-0.65 wt. % C.

4. The mooring chain of claim 1, wherein the austenitic steel comprises 16-20 wt. % Mn.

5. The mooring chain of claim 1, wherein the austenitic steel comprises a non-zero amount of Al<0.08 wt. % Al.

6. The mooring chain of claim 1, wherein the austenitic steel comprises a non-zero amount of N<0.008 wt. % N.

7. The mooring chain of claim 1, wherein the austenitic steel comprises at least 0.01 wt. % Si, at least 0.001 wt. % Al, and at least 0.001 wt. % N.

8. The mooring chain of claim 1, wherein the austenitic steel comprises 5-10 wt. % Cr.

9. The mooring chain of claim 1, wherein the austenitic steel comprises a non-zero amount of Mo<5 wt. % Mo.

10. The mooring chain of claim 1, wherein the austenitic steel has a yield strength of at least about 440 MPa and an ultimate tensile strength of at least about 990 MPa.

11. The mooring chain of claim 1, wherein the austenitic steel has a Charpy notch impact toughness at −20° C. of about 80 J to about 220 J.

12. The mooring chain of claim 1, wherein the austenitic steel has an ASTM G99 wear value characterized by an average pin loss measurement of 2 mg or less and an average disk mass loss measurement of 8 mg or less.

13. The mooring chain of claim 1, wherein the mooring chain comprises a top chain coupled to a bottom chain, the top chain configured for residing above an anticipated water line and the bottom chain configured for residing below an anticipated water line, the top chain and the bottom chain differing compositionally from one another and at least one of the top chain and the bottom chain comprising the austenitic steel.

14. The mooring chain of claim 1, wherein the austenitic steel is processed by a hot rolling procedure, the hot rolling procedure comprising:

hot rolling a steel ingot in a series of hot rolling cycles, each cycle having a progressively decreasing temperature, thereby forming an austenitic steel sheet;

wherein the austenitic steel sheet is decreased in thickness by about 10% to about 25% during each hot rolling cycle; and after a final hot rolling cycle, cooling the austenitic steel sheet to room temperature under a water curtain.

15. A process for mooring a floating offshore structure, comprising:

providing at least one flexible connection between a floating offshore structure located on a body of water and a rigid pile anchor located in a body of water, wherein the rigid pile anchor is secured to the earthen surface located below the body of water;

maintain the position of the floating offshore structure on the body of water through the use of the flexible connection by transferring loading forces imposed upon the floating offshore structure, through the flexible connection and to the rigid pile anchor;

wherein the flexible connection is comprised of a mooring chain, such mooring chain comprising:

a plurality of links comprising an austenitic steel, the austenitic steel comprising:

0.4-0.8 wt. % C, 12-25 wt. % Mn, 4-15 wt. % Cr, a non-zero amount of Si<3 wt. % Si, a non-zero amount of Al<0.5 wt. % Al, a non-zero amount of N<0.1 wt. % N, <5 wt. % Mo, and balance Fe and inevitable impurities;

wherein:

the mooring chain is bare;

at least a portion of the mooring chain is located in a periodic splash zone, wherein the portion of the mooring chain is periodically submerged under the body of water and periodically exposed to air above the body of water; and the body of water is sea water; and the austenitic steel in the periodic splash zone has a corrosion rate of about 0.2 to about 0.7 mils per year (mpy).

16. The process of claim 15, wherein the austenitic steel has a yield strength of at least about 440 MPa and an ultimate tensile strength of at least about 990 MPa; and the austenitic steel has a Charpy notch impact toughness at −20° C. of about 80 J to about 220 J.

17. The process of claim 15, wherein the austenitic steel has an ASTM G99 wear value characterized by an average pin loss measurement of 2 mg or less and an average disk mass loss measurement of 8 mg or less.

* * * * *